US006364656B1

(12) United States Patent
Chen

(10) Patent No.: US 6,364,656 B1
(45) Date of Patent: Apr. 2, 2002

(54) GAS BURNER

(76) Inventor: Wen Chou Chen, No. 4, Lane 657, Chung Cheng Road, Shulin, Taipei Hsien (TW)

( * ) Notice: Subject to any disclaimer, the term of this patent is extended or adjusted under 35 U.S.C. 154(b) by 0 days.

(21) Appl. No.: 09/644,523

(22) Filed: Aug. 21, 2000

(51) Int. Cl.[7] ..... F23D 14/72

(52) U.S. Cl. ..... 431/46; 431/61; 431/80; 431/255; 137/66

(58) Field of Search ..... 431/255, 46, 61, 431/60, 78, 80; 137/65, 66; 236/10

(56) References Cited

U.S. PATENT DOCUMENTS 3,191,661 A * 6/1965 Ray ..... 137/66
3,303,866 A * 2/1967 Ray ..... 137/66
4,080,154 A * 3/1978 Kinsella ..... 137/65
4,610,269 A * 9/1986 Kelly ..... 137/66

* cited by examiner

*Primary Examiner*—Sara Clarke

(57) ABSTRACT

A gas burner includes a gas valve block having a gas input control part connected to a fuel gas source and a gas output control part connected to a flame tube and gas nozzle for producing an igniting flame for burning fuel gas outputted through the flame tube, a differential pressure device adapted to control the fuel gas passage between the gas input control part and the gas output control part through a normal-close valve and a normal-open valve, an electronic igniter controlled by a cock in the gas valve block through a micro-switch to discharge sparks through discharging electrode means for burning fuel gas outputted through the gas nozzle, and a temperature switch for controlling the operation of the normal-open valve and the electronic igniter subject to a predetermined temperature range.

3 Claims, 13 Drawing Sheets

GAS BURNER

BACKGROUND OF THE INVENTION

The present invention relates to gas burners, and more particularly to such a gas burner, which uses a differential pressure device to control the fuel passage from a fuel gas source to the flame tube for main flame, and normal-close and normal-open valve means to control the fuel passage from the fuel gas source to the gas nozzle for igniting flame for burning fuel gas from the flame tube.

In countries of high degree of altitude, people usually use gas burners to keep rooms warm. Regular gas burners for this purpose commonly use a piezoelectric ignition switch (cock) to control the ignition of fuel gas and the intensity of the flame. When in use, the user must hold the piezoelectric ignition switch in the depressed position after the presence of the ignition flame, and then release the piezoelectric ignition switch after the presence of the desired main flame. In case the main flame and/or the igniting flame is extinguished by wind or an accident, the user must depress the piezoelectric ignition switch and then rotate it from the off-position to the on-position again to ignite the ignition flame so as to further ignite the main flame.

SUMMARY OF THE INVENTION

The invention has been accomplished to provide a gas burner, which eliminates the drawbacks of the conventional gas burners. It is one object of the present invention to provide a gas burner, which is easy and efficient in use. It is another object of the present invention to provide a gas burner, which prevents a fuel gas leakage when the main flame is extinguished accidentally. It is still another object of the present invention to provide a gas burner, which is automatically controlled to keep the ambient temperature within the desired range. According to one aspect of the present invention, the gas burner comprises a gas valve block having a gas input control part connected to a fuel gas source and a gas output control part connected to a flame tube and gas nozzle for producing an igniting flame for burning fuel gas outputted through the flame tube, a differential pressure device adapted to control the fuel gas passage between the gas input control part and the gas output control part through a normal-close valve and a normal-open valve, and an electronic igniter controlled by a cock in the gas valve block through a micro-switch to discharge sparks through discharging electrode means for burning fuel gas outputted through the gas nozzle. According to another aspect of the present invention, a temperature switch is electrically connected between the normal-open valve and the electronic igniter, and adapted to automatically control the operation of the normal-open valve and the electronic igniter subject to a predetermined temperature range.

DETAILED DESCRIPTION OF THE PREFERRED EMBODIMENT

Figure 1:
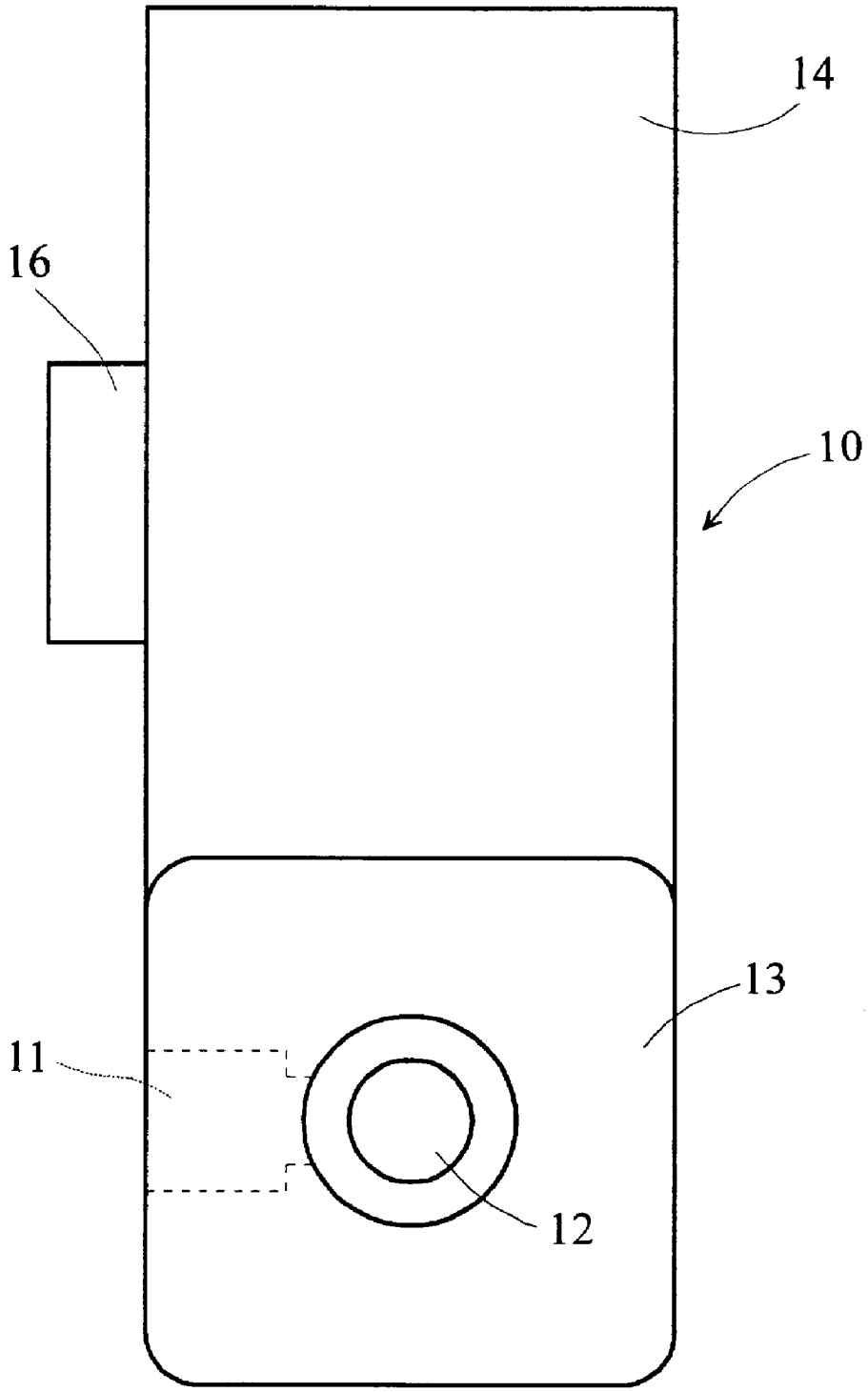
FIG. 1 is a front view of a gas valve block for a gas burner according to the present invention.
Figure 2:
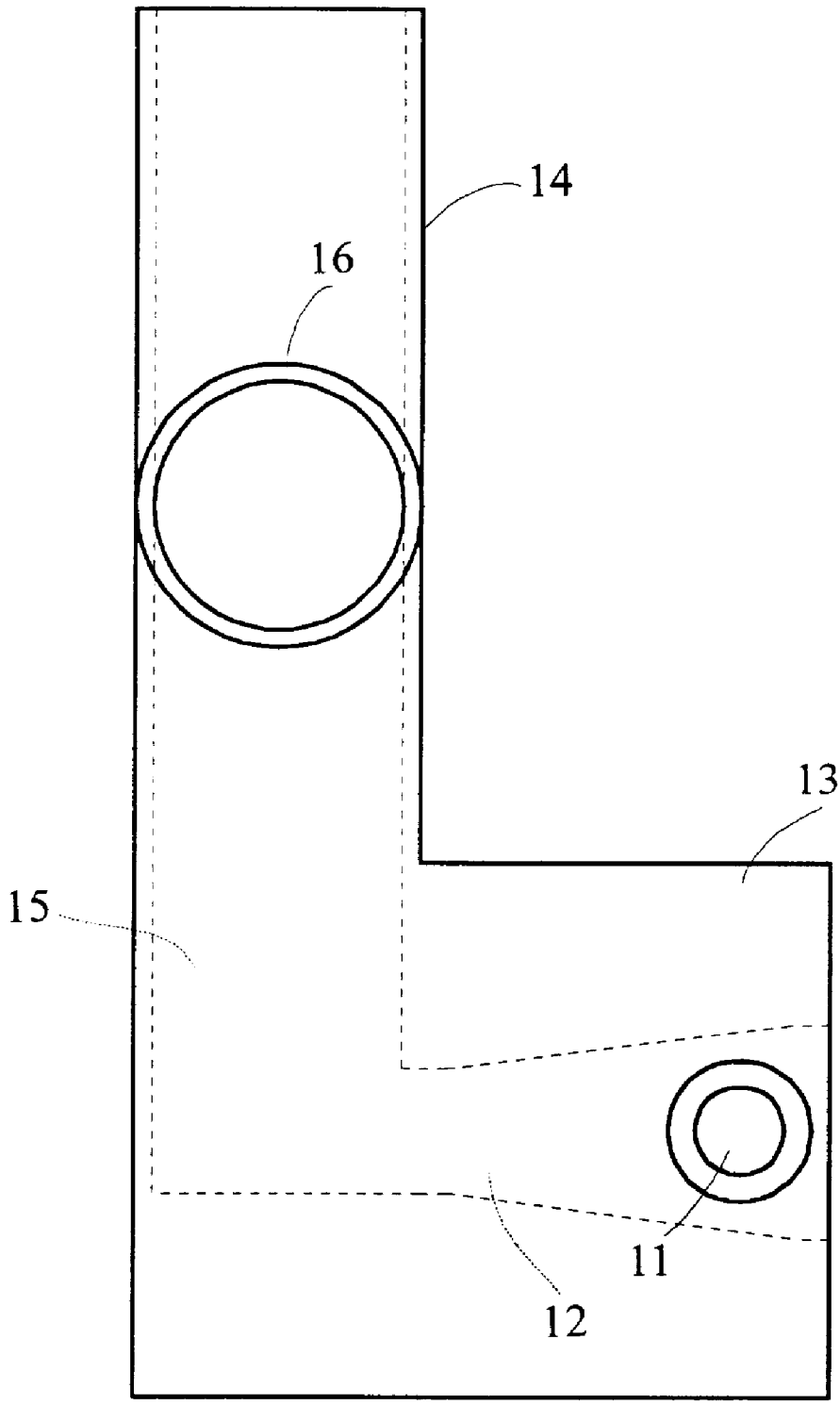
FIG. 2 is a left side view of the gas valve block shown in FIG. 1, showing the arrangement of the internal fuel gas passage.
Figure 3:
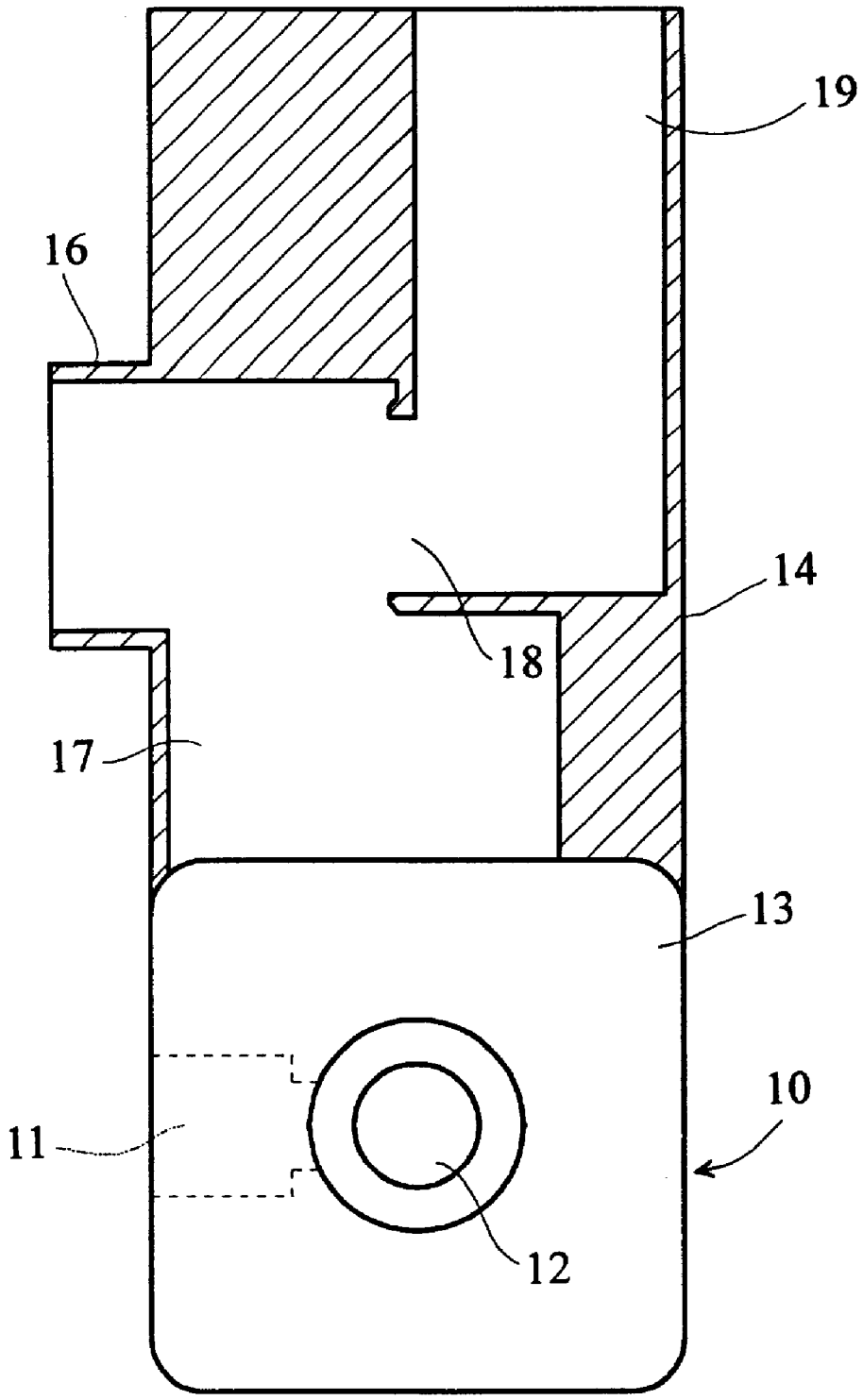
FIG. 3 is a sectional view of the gas valve block shown in FIG. 1, showing the internal structure of the gas output control part.

Referring to FIGS. from 1 through 3, a gas valve block 10 is shown comprising a gas input control part 13, and a gas output control part 14 having a mounting end 16. The gas input control part 13 comprises a gas inlet 11, and an axle hole 12 in communication with the gas inlet 11. The gas output control part 14 comprises a gas passage 15 in communication with the axle hole 12 of the gas input control part 13. The gas passage 15 comprises a gas input hole 17, a gas output hole 19, and a communication hole 18 connected between the gas input hole 17 and the gas output hole 19.

Figure 4:
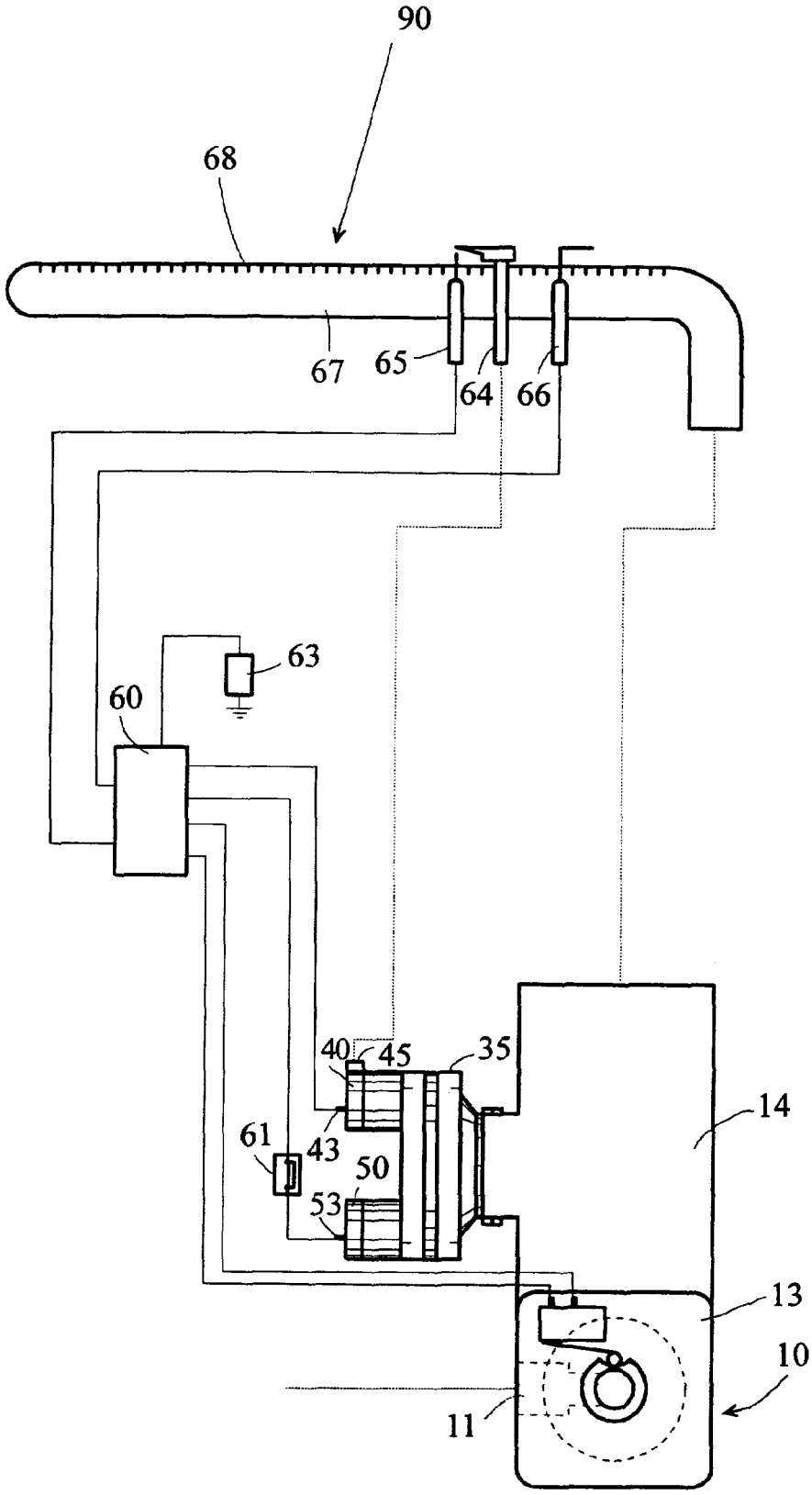
FIG. 4 illustrates the arrangement of the whole system of the gas burner according to the present invention.
Figure 5:
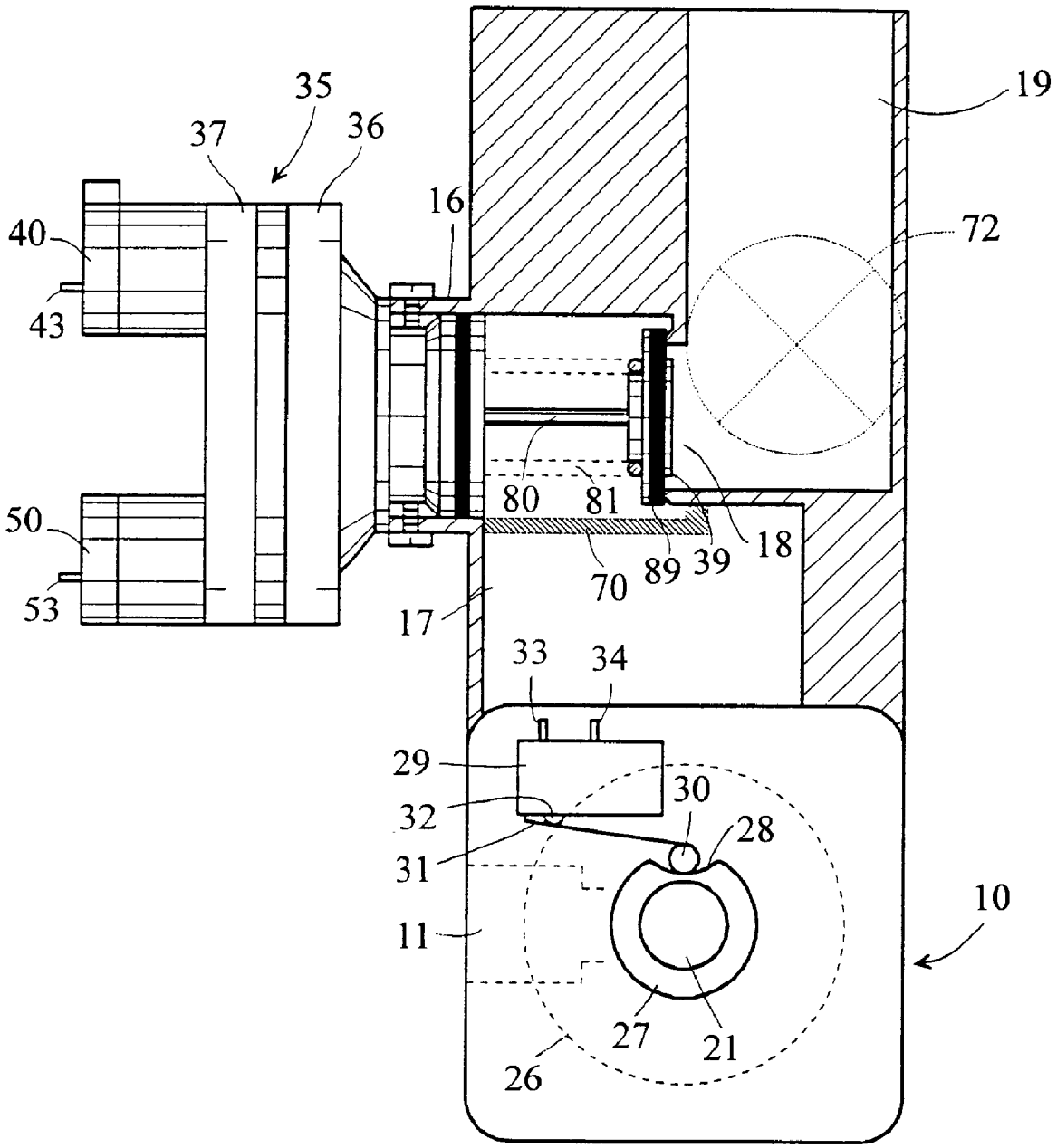
FIG. 5 is a sectional view in an enlarged scale of a part of FIG. 4, showing the arrangement of the differential pressure device and the gas valve block.

Referring to FIGS. 4 and 5, a gas burner 90 is shown comprising a gas valve block 10 (same as the aforesaid gas valve block), a cock 20 coupled to the gas valve block 10, a differential pressure device 35 coupled to the gas valve block 10, the differential pressure device 35 comprising a normal-close valve 40 and a normal-open valve 50, a micro-switch 29 driven by the cock 20, an electronic igniter 60, a battery 63, a gas nozzle 64, a spark discharging electrode 65, an induction electrode 66, and a flame tube 67 having flame holes 68. The normal-close valve 40 has a gas outlet 45 connected to the gas nozzle 64 by a gas pipe. The gas output hole 19 of the gas output control part 14 of the gas valve block 10 is connected to the flame tube 67 by a gas pipe. The electronic igniter 60 is electrically connected to the positive and negative terminals 33 and 34 of the micro-switch 29, and also electrically connected to the terminal 43 of the normal-close valve 40 and the terminal 53 of the normal-open valve 50. A temperature switch 61 is installed in the circuit between the electronic igniter 60 and the normal-open valve 50. The spark discharging electrode 65 and the induction electrode 66 are respectively connected to the electronic igniter 60. The battery 63 is connected to the electronic igniter 60 to provide the necessary working voltage.

Figure 6:
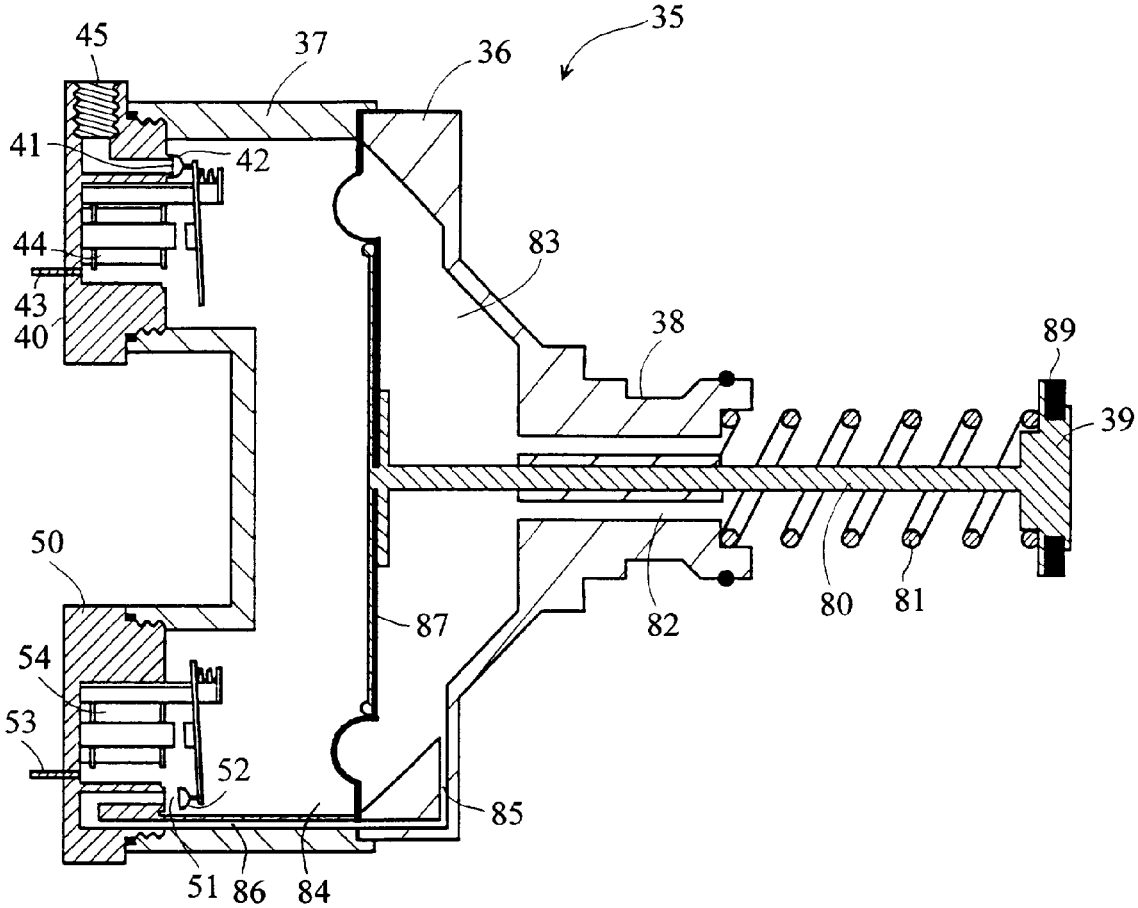
FIG. 6 is a sectional view in an enlarged scale of a part of FIG. 5, showing the internal structure of the differential pressure device.

Referring to FIG. 6 and FIG. 5 again, the differential pressure device 35 comprises a right shell 36, the right shell 36 comprising a mounting portion 38 adapted for coupling to the mounting end 16 of the gas valve block 10 and a through hole 82 through the mounting portion 38, a left shell 37, a rubber diaphragm 87 retained between the right shell 36 and the left shell 37 and dividing the differential pressure device 35 a right gas chamber 83 and a left gas chamber 84, a gas passage 85 communicating between the right gas chamber 83 and the left gas chamber 84, a diaphragm rod 80, the diaphragm rod 80 having one end perpendicularly connected to the center of one side of the rubber diaphragm 87 and an opposite end extended out of the through hole 82 of the mounting portion 38 into the inside of the gas valve block 10 and terminating in a valve stem 39 and a valve washer 89 on the valve stem 39, a compression spring 81 mounted on the valve rod 80 and stopped between the valve stem 39 and the mounting portion 38 of the right shell 36 outside the through hole 82. The compression spring 81 imparts a pressure to the valve stem 39, causing the valve stem 39 and the valve washer 89 to close the communication hole 18. The aforesaid normal-close valve 40 and normal-open valve 50 are bilaterally installed in the left shell 37. The normal-close valve 40 comprises a valve port 41 disposed in communication between the gas outlet 45 thereof and the left gas chamber 84, a winding 44 connected to the terminal 43 thereof, and a valve flap 42 adapted to close the valve port 41 when the winding 44 is energized, or to open the valve port 41 when the winding 44 is disenergized. The normal-open valve 50 comprises a winding 54 connected to the terminal 53 thereof, a gas hole 86 in communication between the gas passage 85 and the left gas chamber 84, a valve port 51 in communication between the gas passage 85 and gas hole 86, and a valve flap 52 adapted to close the valve port 51 when the winding 54 is energized, or to open the valve port 51 when the winding 54 is disenergized.

Figure 7:
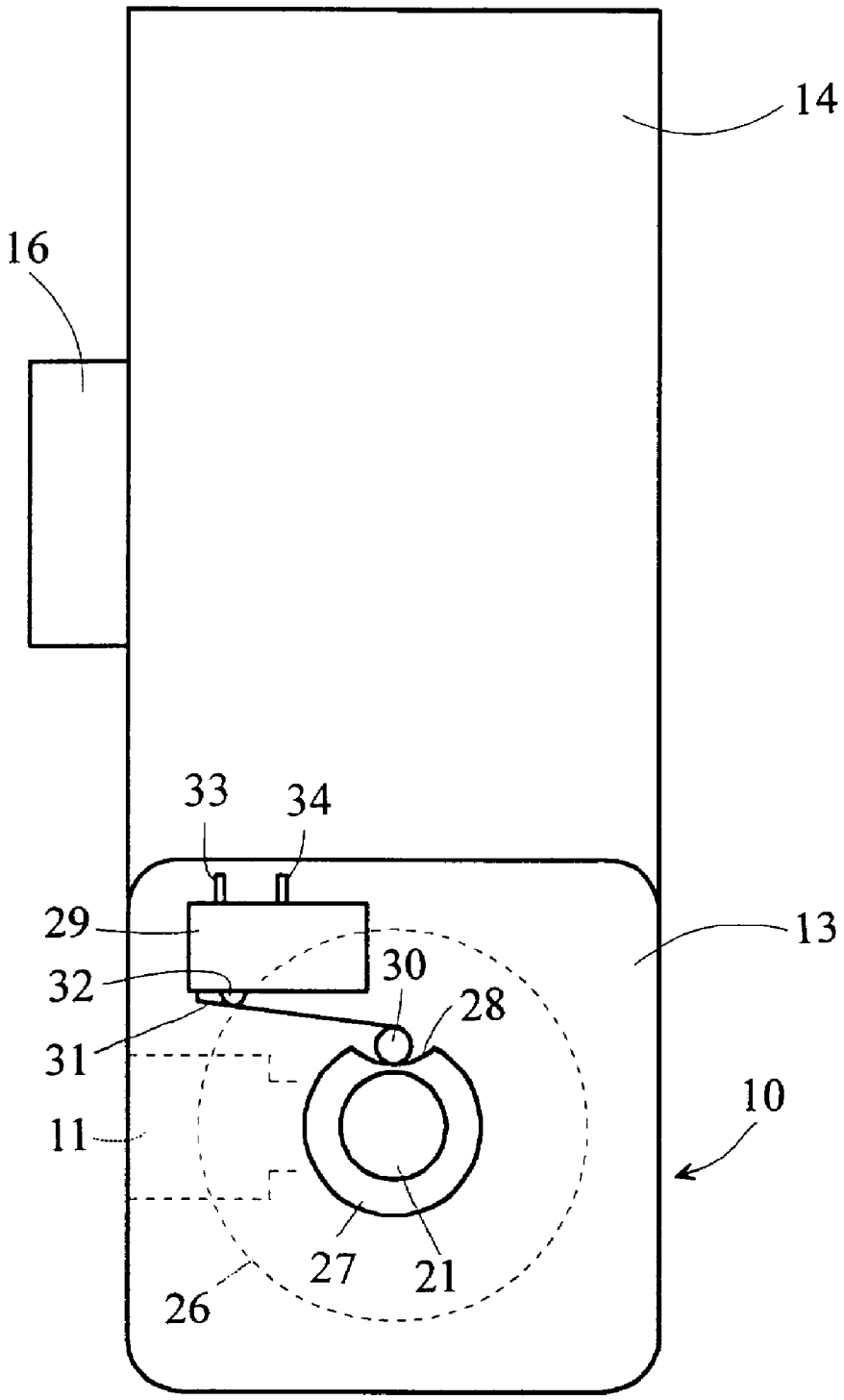
FIG. 7 is a front view of a part of the present invention, showing the cock and the micro-switch installed in the gas valve block.
Figure 8:
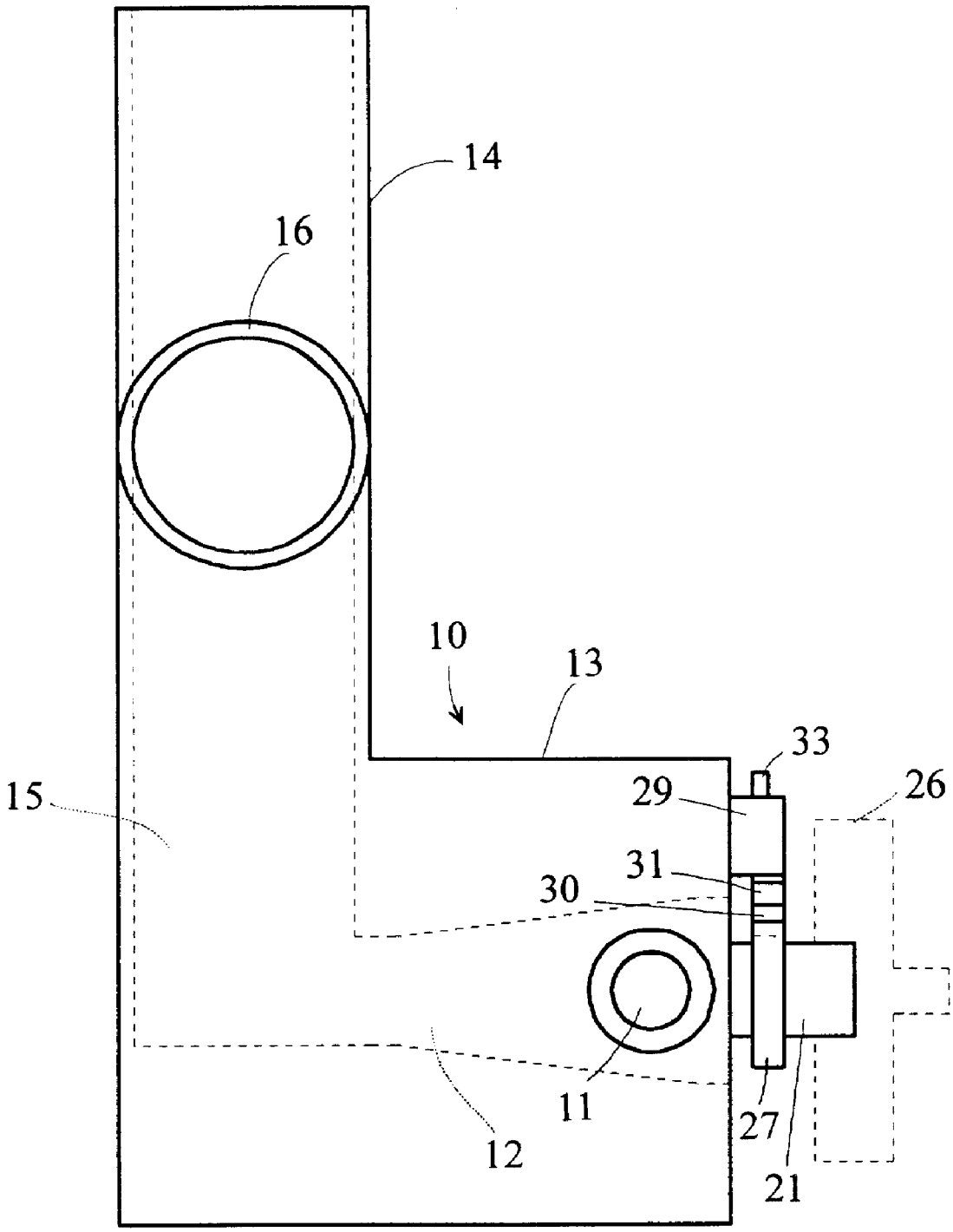
FIG. 8 is a left side view of FIG. 7.
Figure 10:
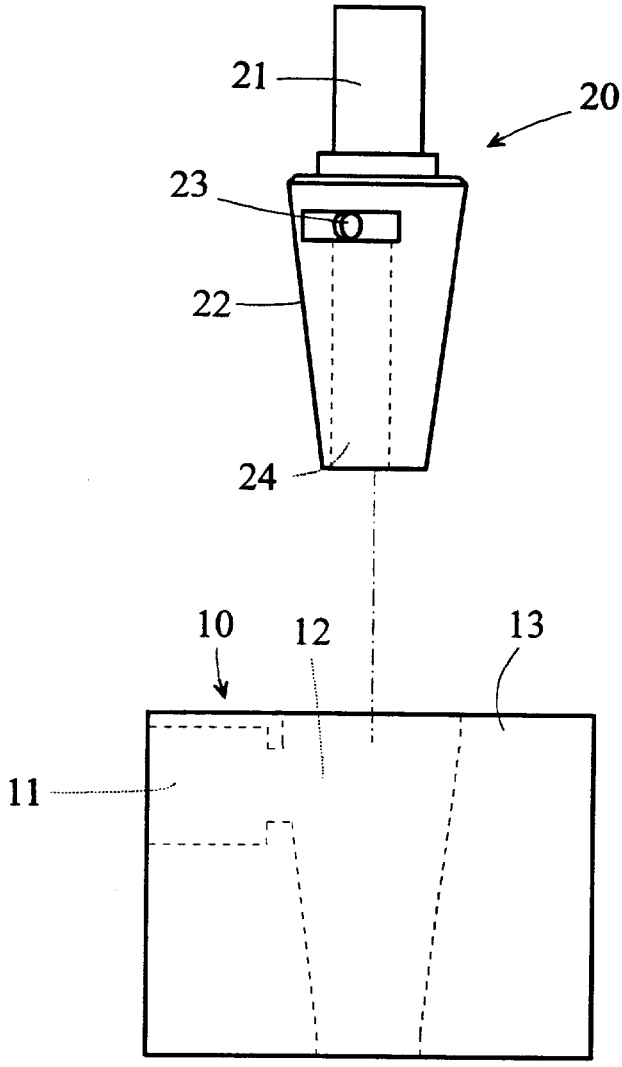
FIG. 10 illustrates the relationship between the cock and the gas input control part of the gas valve block according to the present invention.

Referring to FIGS. 7, 8 and 10, the cock 20 comprises a cock body 22 inserted into the axle hole 12 of the gas input control part 13 of the gas valve block 10, a gas inlet 23 disposed at one lateral side of the cock body 22 and connected to the gas inlet 11 of the gas input control part 13 of the gas valve block 10, a gas outlet 24 disposed at the bottom side of the cock body 22 in communication with the gas inlet 23 and connected to the gas passage 15 of the gas output control part 14 of the gas valve block 10, and a shank 21 extended from the top side of the cock body 22 and fixedly mounted with a knob 26 and a control wheel 27. The control wheel 27 has a peripheral notch 28, which receives a roller 30 at the distal end of an actuating rod 31 of the micro-switch 29. The actuating rod 31 is adapted to activate a contact 32, so as to close/open the circuit between the positive and negative terminals 33 and 34 of the micro-switch 29.

Figure 9:
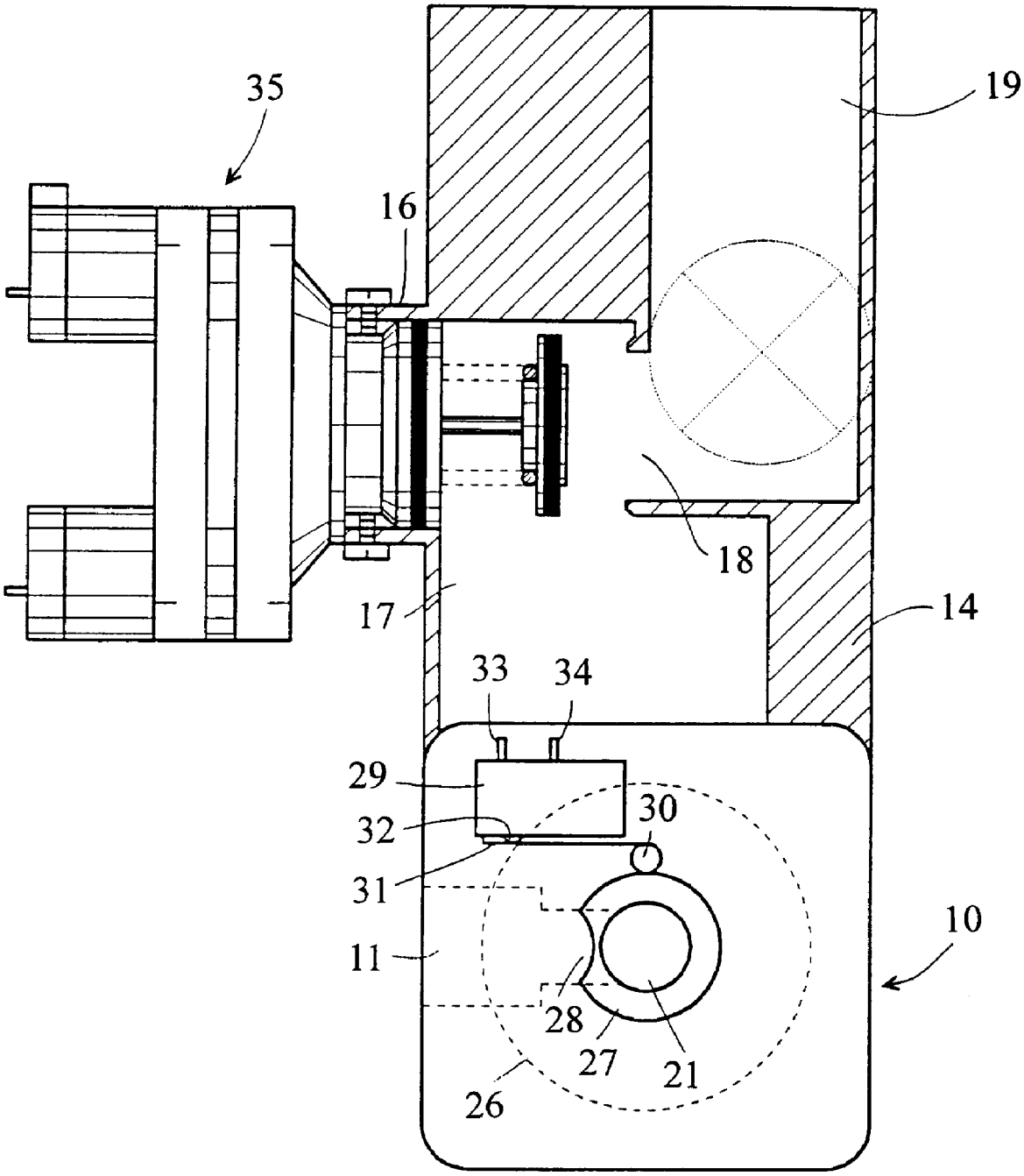
FIG. 9 is similar to FIG. 5 but showing the valve stem of the differential pressure device opened from the communication hole of the gas valve block.

Referring to FIG. 9 and FIGS. 4 and 6 again, when operating the knob 26 to rotate the cock 20 in one direction, the roller 30 is driven by the notch 28 of the control wheel 27 to force the actuating rod 31 in activating the contact 32, thereby causing the terminals 33 and 34 of the micro-switch 29 to be electrically connected, and therefore the electronic igniter 60 is driven to discharge sparks through the discharging electrode 65 and to give a signal to the normal-close valve 40, causing the valve flap 42 to be driven by the winding 44 to open the valve port 41. At the same time, the gas inlet 23 and gas outlet 24 of the cock 20 are respectively disposed in communication with the gas inlet 11 of the gas input control part 13 of the gas valve block 10 and the gas passage 15 of the gas output control part 14 of the gas valve block 10, enabling fuel gas to pass through the through hole 82, the right gas chamber 83, the gas passage 85, the gas hole 86 and the valve port 51 into the left gas chamber 84, and then to pass from the left gas chamber 84 through the valve port 41 and the gas outlet 45 to the gas nozzle 64 and then to be burned by sparks discharged through the discharging electrode 65. Because the valve port 41 of the normal-close valve 40 is opened, an igniting flame goes out of the gas nozzle 64. Upon the presence of the igniting flame, the induction electrode 66 is induced to give a signal to the electronic igniter 60, causing the electronic igniter 60 to stop discharging sparks through the discharging electrode 65, and to send a signal to the normal-open valve 50. Upon receive of the signal from the electronic igniter 60, the normal-open valve 50 is driven to close the valve port 51, preventing fuel gas to pass from the right gas chamber 83 to the left gas chamber 84, and enabling fuel gas to be completely guided out of the left gas chamber 84 to the gas nozzle 64. When the fuel gas in the left gas chamber 84 is gradually reduced, the air pressure in the right gas chamber 83 becomes higher than the left gas chamber 84, thereby causing the rubber diaphragm 87 to be forced by air pressure displace in direction from the right gas chamber 83 toward the left gas chamber 84, and at the same time the diaphragm rod 80 is moved with the rubber diaphragm 87 leftwards, causing the valve stem 39 to compress the compression spring 81, and to open the gas input hole 17, for enabling fuel gas to pass from the gas input hole 17 through the communication hole 18 and the gas output hole 19 to the flame holes 68 of the flame tube 67 for burning by the flame at the gas nozzle 64, and therefore a main flame is produced at the flame tube 67.

In case the igniting flame and the main flame are extinguished by an accident, the induction electrode 66 receives no flame, and the electronic igniter 60 is stopped from sending the signal to the normal-open valve 50, thereby causing the winding 54 of the normal-open valve 50 to open the valve flap 52 from the valve port 51, enabling fuel gas to pass from the right gas chamber 83 to the left gas chamber 84 again. When fuel gas passes from the right gas chamber 83 to the left gas chamber 84, the air pressure in the left gas chamber 84 is gradually increased and becomes in balance with the right gas chamber 83 soon. When the air pressure in the left gas chamber 84 is in balance with the right gas chamber 83, the rubber diaphragm 87 is returned to its former position, thereby causing the valve stem 39 to close the communication hole 18 again, preventing a leakage of fuel gas. At this time, the valve flap 42 of the normal-close valve 40 is still opened from the valve port 41, enabling the electronic igniter 60 to drive the discharging electrode 65 to discharge sparks. If the trouble, which caused the aforesaid accident to happen, still exists at this time, the electronic igniter 60 immediately cuts off the signal from the normal-close valve 40, causing the winding 44 of the normal-close valve 40 to be disenergized, and therefore the valve flap 42 is forced to close the valve port 41.

The aforesaid temperature switch 61 is turned to a broken circuit status when its temperature surpasses a set level, causing the winding 54 of the normal-open valve 50 to be disenergized, so as to extinguish the main flame. At this time the igniting flame still exists. When the main flame is extinguished, and the temperature of the temperature switch 61 drops below the set level, the temperature switch 61 is turned from the broken circuit status to a close circuit status, causing the winding 54 of the normal-open valve 50 to be energized, and therefore the ignition flame is produced again to burn fuel gas at the flame holes 68 of the flame tube 67. Further, a flame adjustment lever 72 is installed and adapted to adjust the intensity of the main flame.

Figure 11:
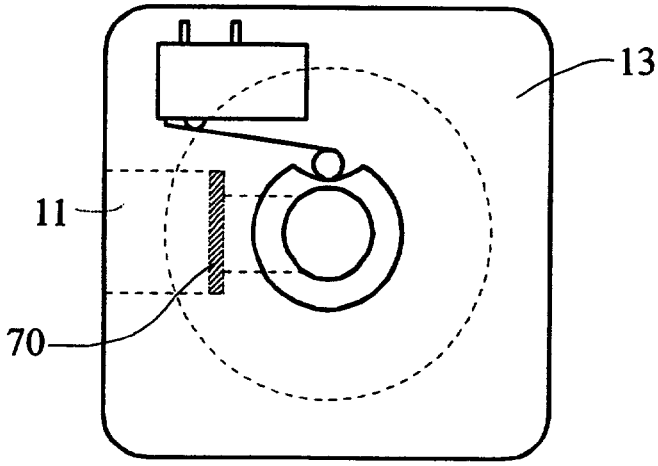
FIG. 11 illustrates a gas filter element installed in the gas input control part of the gas valve block according to the present invention.
Figure 14:
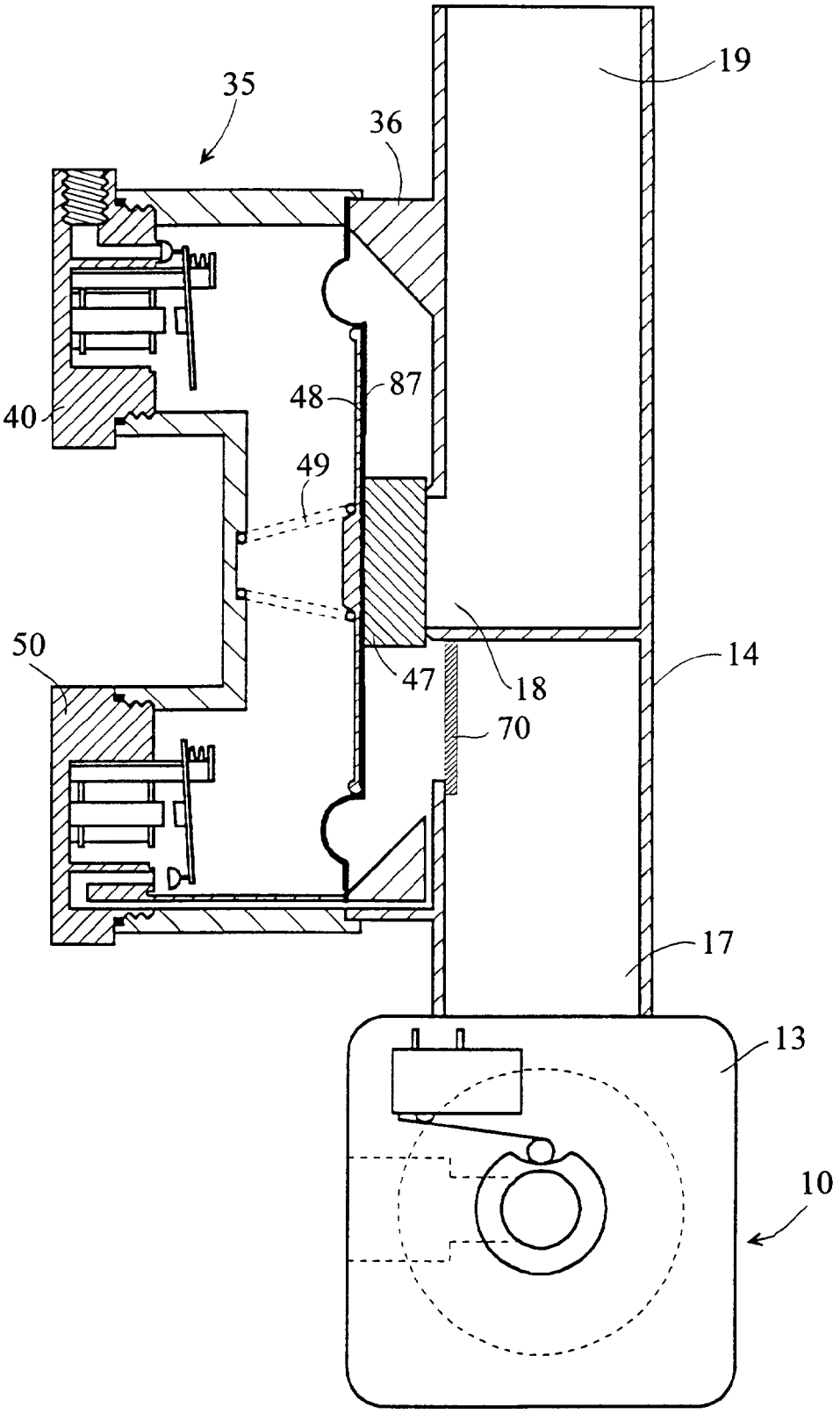
FIG. 14 illustrates an alternate form of the differential pressure device according to the present invention.

Referring to FIGS. 11 and 14 and FIG. 5 again, gas filter elements 70 may be installed in the gas inlet 11 and in the fuel gas passage in front of the differential pressure device 35 to remove solid matter from fuel gas.

Figure 12:
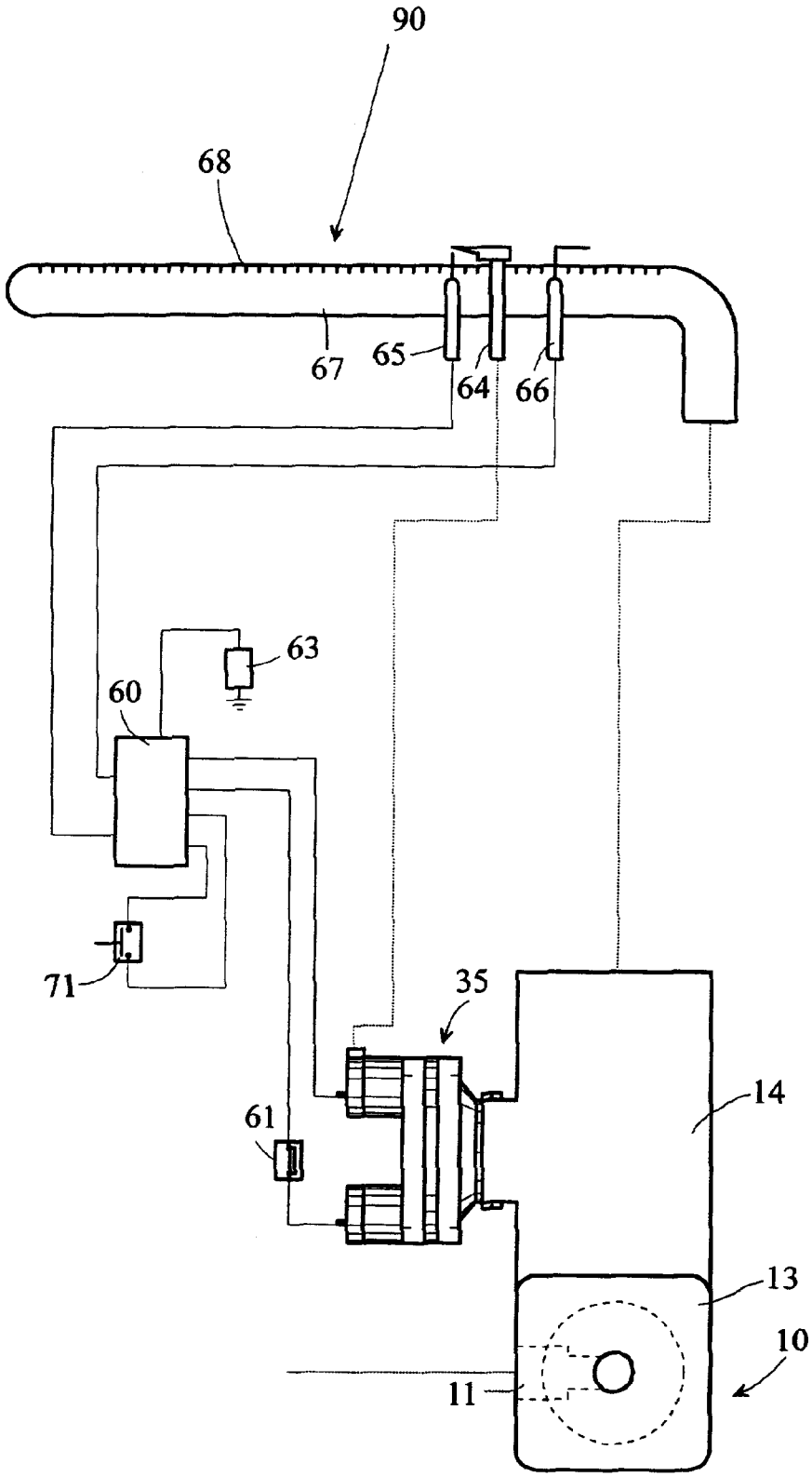
FIG. 12 illustrates an alternate form of the gas burner according to the present invention.

FIG. 12 shows an alternate form of the present invention. According to this alternate form, a manual switch 71 is installed in the gas burner 90 and connected to the electronic igniter 60 instead of the aforesaid micro-switch 29 and control wheel 27. When the manual switch 71 is in the "off" position, the user needs not to turn the knob 26 to the closed position, and the user can directly switch on the manual switch 71 to turn on the electronic igniter 60.

Figure 13:
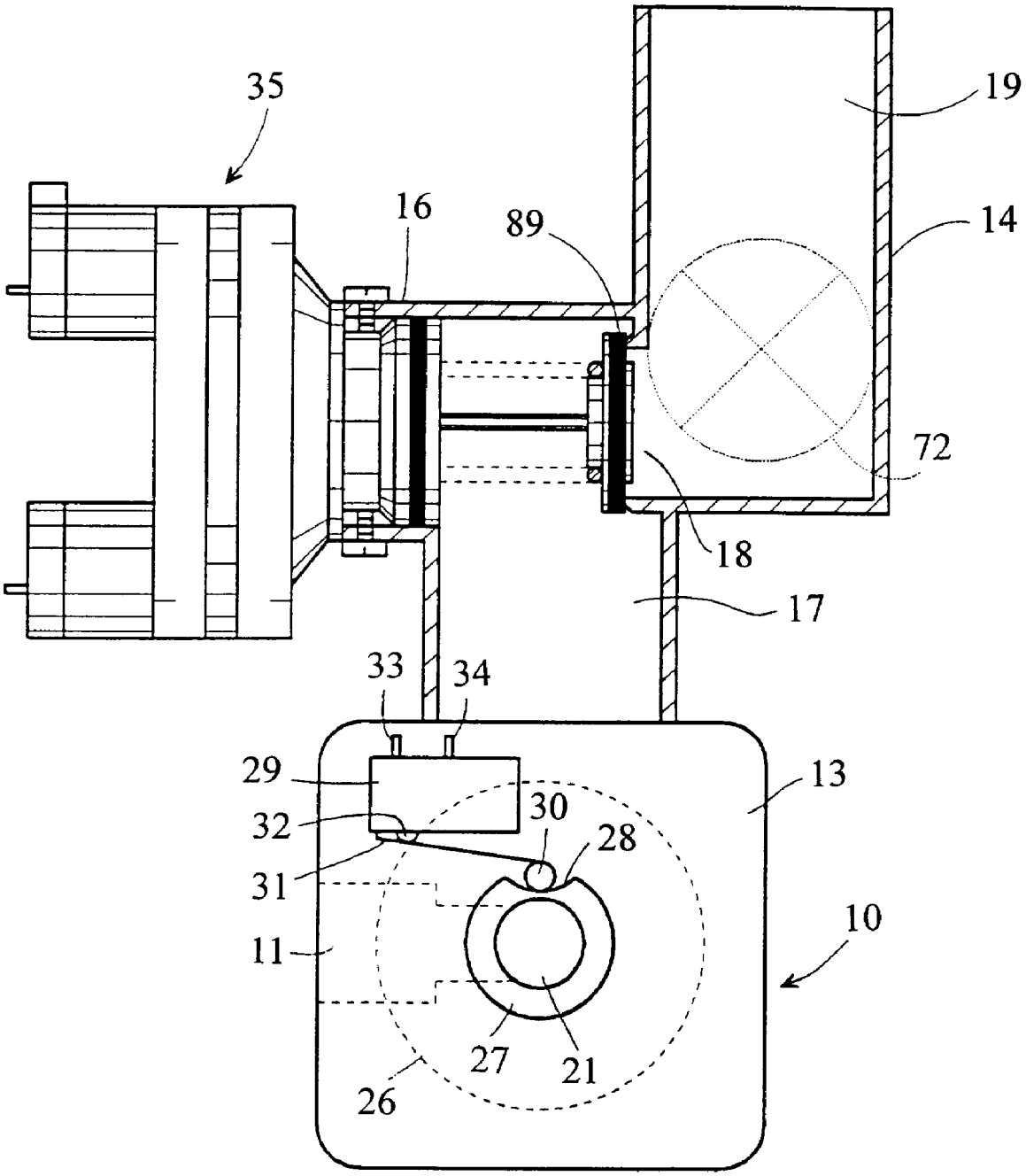
FIG. 13 illustrates an alternate form of the gas valve block according to the present invention.

FIG. 13 shows an alternate form of the gas valve block 10. In the aforesaid embodiments, the gas output control part 14 is formed integral with the gas input control part 13. According to this alternate form, the gas output control part 14 and the gas input control part 13 are two separated members detachably coupled together. When the gas output control part 14 and the gas input control part 13 are coupled together, rubber seal means must be installed to seal the connection area between the gas output control part 14 and the gas input control part 13.

FIG. 14 shows an alternate form of the pressure differential device 35. According to this alternate form, a valve 47 is installed in one side of the rubber diaphragm 87 to control the passage of the communication hole 18, a disk 48 is installed in the other side of the rubber diaphragm 87, and a spring 49 is connected between the disk 48 and the left shell 37. When the valve 47 is forced by the spring 49 to close the communication hole 18 when the air pressure at one side of the rubber diaphragm 87 is maintained in balance with the air pressure at the other side of the rubber diaphragm 87. According to this embodiment, the gas output control part 14 and the gas input control part 13 can be made integral with each other, or separately made and then coupled together.

It is to be understood that the drawings are designed for purposes of illustration only, and are not intended for use as a definition of the limits and scope of the invention disclosed.

What is claimed is:

1. A gas burner comprising:

a gas valve block, said gas valve block comprising a gas input control part, and a gas output control part, said gas input control part comprising a gas inlet, and an axle hole in communication with the gas inlet, said gas output control part comprising a gas passage in communication with the axle hole of said gas input control part, the gas passage of said gas output control unit comprising a gas input hole, a gas output hole, and a communication hole connected between the gas input hole and the gas output hole;

a cock installed in the axle hole of said gas valve block and rotated to close/open the passage between the gas inlet of said gas input control part of said gas valve block and the gas input hole of said gas output control part of said gas valve block;

a gas nozzle;

a flame tube connected to the gas output hole of said gas output control part of said gas valve block, said flame tube having a plurality of flame holes;

a differential pressure device coupled to the gas output control part of said gas valve block and adapted to close/open the communication hole between the gas input hole and gas output hole of said gas output control part of said gas valve block, said differential pressure device defining a right gas chamber disposed in communication with the communication hole of said gas output control part of said gas valve block, a left gas chamber, a rubber diaphragm suspended between said right gas chamber and said left gas chamber, a diaphragm rod moved with said rubber diaphragm to close/open the communication hole of said gas output control part of said gas valve block, and spring means adapted to force said diaphragm rod into a position of closing the communication hole of said gas output control part of said gas valve block;

discharging electrode means;

an electronic igniter controlled to discharge sparks through said discharging electrode means for burning fuel gas outputted through said gas nozzle to produce an igniting flame for burning fuel gas outputted through the flame holes of said flame tube;

a battery adapted to provide a necessary working voltage to said electronic igniter;

a micro-switch controlled by said cock to turn on/off said electronic igniter;

a normal-close valve installed in said differential pressure device and electrically connected to said electronic igniter and suitable to be used in a fuel gas passage connected between the left gas chamber of said differential pressure device and said gas nozzle;

a normal-open valve installed in said differential pressure device and electrically connected to said electronic igniter and controlled by said micro-switch to control a fuel gas passage between said right gas chamber and said left gas chamber of said differential pressure device; and an induction electrode electrically connected to said electronic igniter, and adapted to detect whether an igniting flame occurs and to output a signal to said electronic igniter and said normal-open valve when no ignition flame at said gas nozzle is detected, for causing said electronic igniter to stop discharging sparks through said discharging electrode means and said normal-open valve to close the passage between said right gas chamber and said left gas chamber.

2. The gas burner of claim 1 further comprising a temperature switch electrically connected between said normal-open valve and said electronic igniter for controlling an operation of said normal-open valve and an operation of said electronic igniter to be within a predetermined temperature range.

3. The gas burner of claim 1 further comprising gas filter means installed in the gas input control part of said gas valve block.

* * * * *